US010021918B2

(12) United States Patent
Kremer

(10) Patent No.: US 10,021,918 B2
(45) Date of Patent: Jul. 17, 2018

(54) SELF-SUPPORTING GARMENT

(71) Applicant: Klaus Kremer, Paderborn (DE)

(72) Inventor: Klaus Kremer, Paderborn (DE)

( * ) Notice: Subject to any disclaimer, the term of this patent is extended or adjusted under 35 U.S.C. 154(b) by 155 days.

(21) Appl. No.: 14/904,101

(22) PCT Filed: Jul. 2, 2014

(86) PCT No.: PCT/DE2014/100224
§ 371 (c)(1),
(2) Date: Jan. 10, 2016

(87) PCT Pub. No.: WO2015/007266
PCT Pub. Date: Jan. 22, 2015

(65) Prior Publication Data

US 2016/0143366 A1 May 26, 2016

(30) Foreign Application Priority Data

Jul. 17, 2013 (DE) ..... 10 2013 107 588
Jul. 24, 2013 (DE) ..... 10 2013 107 893

(51) Int. Cl.
*A41B 9/02* (2006.01)
*A41B 9/00* (2006.01)
*A41D 7/00* (2006.01)

(52) U.S. Cl.
CPC ..... *A41B 9/002* (2013.01); *A41D 7/005* (2013.01); *A41B 2400/44* (2013.01); *A41B 2400/70* (2013.01)

(58) Field of Classification Search
CPC ..... A41D 7/005; A41D 13/1254; A41D 13/0537; A41D 15/005; A41D 1/088; A41D 2300/32; A41D 2300/328; A41D 7/00; A41B 9/002; A41B 9/001; A41B 2300/30; A41B 2400/52; A41B 2300/32; A41B 9/007; A41B 9/02; A41B 9/008; A41B 9/04; A41B 9/004; A41B 13/04; A41F 9/00
See application file for complete search history.

(56) References Cited

U.S. PATENT DOCUMENTS 2,085,425 A * 6/1937 Goodwin ..... A41D 7/005 2/406
2,408,723 A * 10/1946 Arpin ..... A41B 9/002 2/238

(Continued)

FOREIGN PATENT DOCUMENTS

AT 215927 6/1961
AT 12769 8/2013

(Continued)

*Primary Examiner* — Bobby Muromoto, Jr.
(74) *Attorney, Agent, or Firm* — Smartpat PLC

(57) ABSTRACT

The present invention relates to a self-supporting garment for the lower body, closed either only in front or in back, or partially open in front and in back, comprising a lower support strap (5; 11) and one or two upper support straps (4; 9,10), which are connected to one another at a front connecting point (6; 12) and/or at a rear connecting point (7; 13), where the support straps lying against the pelvis (4,5) or support straps (9,10) and their respective connecting points (6; 7; 12,13) are manufactured of a dimensionally stable and elastic material.

19 Claims, 4 Drawing Sheets

(56) References Cited

U.S. PATENT DOCUMENTS 2,500,255 A * 3/1950 Lee ..... A61F 13/49004 604/392
2,534,934 A * 12/1950 Viniegra ..... A41B 9/002 128/846
3,094,990 A * 6/1963 Neilson ..... A41B 9/002 2/400
3,243,824 A * 4/1966 Overholt ..... A41D 7/005 2/238
3,654,630 A * 4/1972 Block ..... A41D 7/005 2/238
3,774,241 A * 11/1973 Zerkle ..... A41B 9/002 2/403
3,774,247 A * 11/1973 Bradley ..... A47C 19/022 5/53.2
4,028,740 A * 6/1977 Luerken ..... A41D 7/005 2/67
4,121,305 A * 10/1978 Kolker ..... A41B 9/002 2/406
4,229,835 A * 10/1980 Shaw ..... A41B 9/001 2/221
4,414,691 A * 11/1983 Estruch ..... A41D 7/00 2/400
4,459,703 A * 7/1984 Kosmas ..... A41D 13/0537 2/338
4,498,201 A * 2/1985 Carter ..... A41F 9/00 2/220
4,597,110 A * 7/1986 Smith, Sr. ..... A41B 9/007 2/406
4,615,051 A * 10/1986 Hashimoto ..... A41B 9/004 2/406
4,698,855 A * 10/1987 Hicks ..... A41B 9/001 2/402
4,937,887 A * 7/1990 Schreiner ..... A44B 18/00 2/237
5,347,657 A * 9/1994 Unsell ..... A41D 7/005 2/237
5,367,715 A * 11/1994 Leonard ..... A41D 7/005 2/400
5,423,789 A * 6/1995 Kuen ..... A61F 13/64 604/386
5,535,452 A * 7/1996 Rozenblat ..... A41B 9/02 2/403
5,551,093 A * 9/1996 Stricker ..... A41B 9/001 2/400
5,704,933 A * 1/1998 Fell ..... A61F 13/64 2/265
6,012,168 A * 1/2000 Hutton ..... A41D 13/1254 2/114
6,092,242 A * 7/2000 Niedermeyer ..... A41B 9/008 2/400
6,247,184 B1 * 6/2001 Watts ..... A41B 9/001 2/400
6,560,786 B2 * 5/2003 Lipton ..... A41B 9/008 2/400
D505,767 S * 6/2005 Cabrera ..... 2/400
D507,856 S * 8/2005 Yeramyan ..... 2/400
D539,421 S * 3/2007 Donehue ..... D24/124
7,685,652 B2 * 3/2010 Digney ..... A41B 9/002 2/406
8,087,098 B2 * 1/2012 Kimberly ..... A41B 9/001 2/227
8,108,950 B1 * 2/2012 Bowersox-Evans ..... A41B 9/04 2/406
8,499,364 B2 * 8/2013 Dye ..... A41B 9/002 2/400
8,769,717 B2 * 7/2014 Holland ..... A41D 7/005 2/67
D711,071 S * 8/2014 Jackson ..... D2/712
2004/0064872 A1 * 4/2004 Ruiter ..... A41B 9/002 2/400
2006/0101558 A1 * 5/2006 Coleman ..... A41D 13/1254 2/400

FOREIGN PATENT DOCUMENTS

| | | | |
|---|---|---|---|
| DE | 1715606 | U | 1/1956 |
| DE | 1826212 | U | 2/1961 |
| DE | 3705137 | | 10/1987 |
| DE | 3717042 | A1 | 12/1988 |
| DE | 29511963 | U1 | 10/1995 |
| DE | 29707233 | U1 | 6/1997 |
| DE | 19820715 | A1 | 11/1999 |
| DE | 202004010174 | U1 | 9/2004 |
| DE | 10307173 | | 11/2004 |
| DE | 202004011134 | U1 | 11/2004 |
| DE | 10361500 | A1 | 7/2005 |
| DE | 202006000289 | U1 | 7/2006 |
| DE | 102005044687 | A1 | 3/2007 |
| DE | 202007004057 | U1 | 10/2007 |
| DE | 102008056229 | A1 | 5/2010 |
| DE | 202010004721 | U1 | 8/2010 |
| DE | 202013002595 | U1 | 3/2013 |
| DE | 202013103188 | U1 | 8/2013 |
| FR | 2740302 | | 4/1997 |
| GB | 2398992 | | 9/2004 |
| WO | 2005110132 | A1 | 11/2005 |

* cited by examiner

SELF-SUPPORTING GARMENT

TECHNICAL FIELD

The present invention relates to a self-supporting garment, and more particularly to a dimensionally stable thong.

BACKGROUND

Among the publicly wearable styles known from the prior art are various versions of non-dimensionally stable garments that are self-contained as worn, or self-supporting garments that leave the sides of the lower body uncovered, similar to that mentioned above. Closed versions of such garments also cover the buttocks and sides of the lower body, to a degree varying in different styles. Other styles are worn only as undergarments or together with other garments, are used in the medical field, or serve as supports for other garments.

Further features of the prior art are presented below from the following description of exemplary embodiments by means of the drawings.

As can be seen from FIGS. 1-3, a strap 2 running between the legs is provided in known garments, such strap connected in front and in back with a support strap 1 of the garment running around the circumference of the body, in some cases releasably. As the support strap 1 and/or the strap 2 are not themselves dimensionally stable, nor connected in a dimensionally stable manner, the strap 2 running between the legs would fall down if not connected, as well as to the front or rear like a thread supported at only one end, insofar as the strap 2 were connected only at one end with the circumferential support strap 1 at the opposite side. The sold exception is the "C-string" depicted in FIG. 4, which covers only the area between the legs by means of a strap 2, and which is prevented from falling off by its design, in which tension is created between the legs. It therefore comprises only a single strap 2. While T- and G-strings have long been worn, the origin of the V-string (or delta string), with its delta-shaped, textile-free triangle over the coccyx is unknown. A C-string is described e.g. in US 2004 0 064 872 A1.

The width and form of the support straps 1 and straps 2 vary in different versions (FIGS. 1 through 4). With the exception of the C-string (see FIG. 4), these are not dimensionally stable, but instead generally only comprise non-dimensionally stable support straps 1 of any width and form. The material is normally a fabric or other material that conforms to the body. The forms illustrated in FIGS. 1 through 3 are only created upon contact with the body of the wearer, through which the fabric is stretched to the size fitting the body. The tension so created prevents the garment from slipping downward. With the exception of the C-string shown in FIG. 4, the garments do not have the forms depicted when not being worn.

It is characteristic that either—as in the C-string of FIG. 4—only a single, self-supporting strap 2 exists, or that support strap 1 and strap 2—as depicted in FIGS. 1 to 3—are connected in front and back, possibly releasably, as the strap 2 would otherwise fall down between the legs. If a support strap 1 encircling the body is provided, this strap is always closed when the garment is worn (FIGS. 1 through 3; possibly opened using one or more closures 3, as shown in FIG. 1; these may be attached at the front, sides, or rear within the support strap 1, or also below within the strap 2).

It is thus known that a circumferential support strap 1 is always kept closed when worn, and a strap 2 including a crotch piece is connected between the legs in front and in back with a circumferential support strap 1 (FIGS. 1 through 3). The front and rear connection between the support strap 1 and the strap 2 is absolutely necessary to the functioning (covering of the regions of the body to be concealed) of the versions of FIG. 1 to FIG. 3 in order to prevent the strap 2 from falling off. In the version of FIG. 4, such falling off is prevented in accordance with the prior art by tension between the legs generated by the material of the strap 2.

The undergarments, which also cover the sides to a greater or lesser extent, can only be put on and taken off by drawing non-opening models up and down along the legs. In the case of openable models, e.g. those using buttons, hooks, zippers, or ties—as closure 3 in FIG. 1—the garment must be either opened or also drawn over the legs to be put on and taken off. Only the C-string in FIG. 4 can be removed directly; however, it does not cover the wearer's sides, thus she appears unclothed from the side. In addition, if the tension exerted by the strap 2 is insufficient, the garment may slide down or fall off.

The garment described in U.S. Pat. No. 6,012,168 always appears closed from the front and back, as the supporting strap is intended to fully encircle the body like a belt (though potentially not closed by a closure 3). This encirclement of the body is required. The objective is to loosely cover the buttocks of a patient, as the front half of the body is covered by another garment. This garment thus does not itself cover the crotch area. As the crotch area itself is not covered, and the buttocks only by a dangling piece of cloth, coverage is not ensured, e.g. in the event of a gust of wind. This garment thus cannot be worn in public, at least not unless worn in combination with another garment.

DE 103 07 173 B3 relates to a garment having a loincloth with a waistband from which at least one front apron part depends, where the garment has a front crotch piece and a rear crotch piece connected to it, where the crotch pieces are connected to the waistband at their terminal ends opposite to one another. The waistband is continuous and not sufficiently dimensionally stable. The purpose of the loosely depending aprons is to cover more.

U.S. Pat. No. 3,774,241 A also describes a continuous belt as a support.

FR 2 740 302 A1 comprises a cord encircling the body when the garment is worn, such cord supporting a metal or plastic frame designed to emulate in shape the male or female genital region, but which extends only to the perineum, and thus does not cover the entirety of the private areas between the legs.

DE 103 07 173 B3 accurately describes FR 2 740 302 A1 as comprising essentially a specially-shaped corset which probably cannot be worn in public: in the event of any athletic movement, the body is revealed, as the garment does not encircle the body beyond the middle of the body between the legs, as would be necessary to prevent the clothing from lifting off the body.

DE 103 61 500 A1 describes a v-shaped task, with a cord in the shape of a string encircling the body.

DE 3 705 137 C2 describes a warp-knitted v-shaped slip (of traditional design).

DE 297 07 233 U1 provides for an annularly arranged.

DE 10 2008 056 229 describes a slip, characterized by having a band and a cloth, the latter of which can be releasably attached to a band by at least one end section of its longitudinal extension and is washable. The two end sections of the band are preferably releasably attachable to one another. It is stated that the band may have a closed annular form; in the particularly preferred embodiment, however, the band has end sections that are releasably attached to one another. It is thus visually closed as worn.

DE 20 2004 011 134 U1 concerns a method of opening a slip.

DE 10 2005 044 687 A1 describes briefs with closures arranged on both sides.

DE 37 17 042 A1 places an endless drawstring around an endless elastic waistband.

US 2006/01 01 558 A1 comprises a circumferential belt.

DE 20 2006 000 289 U1 describes a waist support for pants or the like which are supported below the waist on the wearer's body directly or on the undergarment, held in place with the aid of traction mechanisms encompassing the wearer's body.

DE 1715 606 U1 defines a pant support with a broad, closed stomach belt.

In DE 295 11 963 U1, support parts were attached to the upper side of a sturdy belt to be worn in a low hip location on the undergarments.

DE 18 26 212 U1 describes a further pant support, as do AT 21 5927, U.S. Pat. No. 4,498,201, U.S. Pat. No. 4,498, 201, DE 195 53 444, DE 198 20 715 A1 pant support with circumferential belt.

DE 20 2007 004 057 U1 comprises a short pant/underpant, which is opened and closed in the front area along two vertical closure elements, and thus only describes an arrangement of closures; as worn, the pants are closed. The same applies for DE 20 2013 002 595 U1.

GB 2 398 992 describes a variant of a G-string designed to not be visible when worn with low-cut trousers. It is closed in itself.

U.S. Pat. No. 4,459,703 has an entirely different intended purpose, but here as well, the supporting belt is closed.

WO 2005/110132 A1 describes an closed thong, which can be opened at three locations in front.

AT 12 769 U3 describes a slip that opens at the back, but is otherwise "normal".

DE 20 2010 004 721 U1 describes a slip that does not cover the buttocks, and which is supported by two independent "scaffolding pieces" of a springy material, comprising a forward, upper yoke around the pelvis opposite a rear yoke around the legs below the buttocks, the two connected by a non-dimensionally stable strip of fabric, so that the garment as a whole is also not dimensionally stable. The upper yoke is closed by an elastic closing part after being drawn over the body, so that the garment is also not open at the top. This slip cannot be worn, since, when the wearer is walking, only one half of the lower yoke can remain in contact with the skin below the buttocks, as one leg moves forward and one rearward away from the pelvis during walking (or running); accordingly, the leg moving forward necessarily loses contact with the lower yoke.

Both sides of the lower yoke lose contact with the legs if the legs are spread wider than the breadth of the lower yoke. The same applies for sitting, as the legs then form an angle of 90 degrees with the front side of the upper body (180 degrees when standing), and the lower yoke must lose contact with the body on both sides, due to the much smaller distance between the yokes relative to their distance in a standing position, unless the piece of fabric is placed under extreme tension. In that case, however, it would then draw the yokes together in a standing position so tightly that they would press or even cut into the flesh due to the greater distance between them. If the fabric connecting piece becomes wet, it generally becomes unstable, expands, and loses its tensile strength, and the lower yoke will slip or fall off entirely, as it would also do during swimming. By its very design, it would be incapable of following the spreading and other complex leg motions during the breaststroke, though it would have to, as the holding in place below the buttocks is above the moving legs. In terms of leg motion, the crawl stroke is comparable to walking/running; accordingly, here as well it cannot hold. A garment according to this design will thus stay in place at best when standing; when sitting, walking, swimming a crawl stroke, or during all athletic activities involving a spreading of the legs (all ball sports (tennis, soccer/football, (beach) volleyball, etc.), breast and back stroke, surfing, etc.) or when wet, it is inherently impossible for a garment of this design to remain in place.

In addition to bikini tops, DE 20 2004 010 174 U1 describes primarily expanded, multi-piece C-strings of complex design/structure with additional supports/braces and cutouts. In order to securely retain the garment in place, DE 20 2004 010 174 U1 requires mounts over the buttock area, namely either different, outward-curving "strip continuances" or "tail sections" are supposed to provide support in the horizontal direction. The upward- or downward-curved components increase the wearer's risk of injury if they slip and no longer lie flat against the skin, and are pressed into the skin and/or internal organs e.g. during a fall or under some other externally applied force. U.S. Pat. No. 5,367,715 A describes a C-string with a rear yoke also on the buttock region, a sort of subset of the designs in DE 20 2004 010 174 U1, while US 2004 0 064 872 A1 describes what is today an almost standard C-string with no upper mounts, approximately as in its original form.

The drawbacks of the previous solutions—in particular those depicted in FIGS. 1 to 3—are first that they cannot be removed without the participation of the legs in the action of putting them on or taking them off, or can only be removed from the front or back after opening closures 3, unless protection against slippage is dispensed with as in FIG. 4. Furthermore, in FIGS. 1 through 3, neither bare buttocks nor a bare abdomen are possible due to the encircling support strap 1 and its connection in front and in back with the strap 2 between the legs unless such securing is omitted, nor can a partially uncovered buttock region/back be combined with a partially bare abdomen. In contrast, free removability in accordance with FIG. 4 requires, in addition to omission of any securing against slippage by a supporting strap, that the sides of the body are completely uncovered, and thus that the lower body of the wearer appears unclothed as seen from the side. The design of FIG. 4 also necessitates the simultaneous nakedness of the buttocks, back, and abdomen, as well as the sides of the body; a choice of uncovered buttocks or an uncovered abdomen, or alternatively an uncovered side or partially uncovered sides is not possible. DE 20 2010 004 721 U1 demonstrably does not remain in place during movement, and is thus a faulty design that does not fulfill its intended purpose. If offering a secure purchase on the body, DE 20 2004 010 174 U1 imposes risk of injury, including through the components located over the buttocks.

SUMMARY

The present invention has as its objective the creation of a garment for the lower body which does away with the aforementioned drawbacks and which is suitable to be put on and taken off without the involvement of the legs while permitting the abdomen and/or buttocks to be partially uncovered and covering at least one side of the body while at the same time, when worn, not place the wearer at risk of the involuntary exposure, in particular during movement, of parts of the body covered by the garment, and due to its design mechanically prevent an unwanted tearing off to the front or rear in the event of a partially covered back and abdomen. In addition, while at least partially covering at least one side of the body (e.g. as beach or bathing wear, or as an undergarment), the garment must ensure adequate concealment of the lower body while nonetheless permitting—depending on the embodiment—new fashionable variants, e.g. through partially or completely uncovered buttocks, a partially or completely uncovered abdomen, or simultaneously uncovered abdomen and buttocks.

The aforementioned objective is achieved in accordance with the preamble of claim 1 in conjunction with its defining features. Advantageous embodiments and further developments of the garment in accordance with the invention are provided in the dependent subclaims.

A garment of the type specified above is characterized in accordance with the invention in that the garment comprises a lower support strap and one or two upper support straps which are connected to one another at a front connecting point and/or at a rear connecting point, where the support straps fitting against the pelvis and their corresponding connecting points are made of a dimensionally stable and elastic material, where either the upper support strap that is unconnected at either the front or the back, open, and extends on both sides beyond the lateral center of the body, or a front and a rear upper support strap with an open end extending beyond the lateral center of the body one on side, each together with the lower support strap connecting them between the legs, conforms to the body such that, due to the dimensional stability and elasticity of the material used for all components, the slippage and falling off of the partially open garment is prevented even during movement of the body, and a putting on and taking off is enabled, where, additionally, in the case of dual support straps, the free end of the lower support strap extending beyond the center of the body prevents the accidental uncovering of the areas of the body to be concealed in consequence of the lifting up of the garment, and, in the case of triple support straps, an unwanted pulling off toward the front or back is mechanically counteracted.

In the case of an upper load-bearing support strap, its two free ends are, in contrast to the free, ribbonlike support straps known from the prior art, not connected with one another. In this version, only one end of the lower support strap is connected in the front or at the rear with the single upper support strap, and the second end is thus unconnected and free.

In the case of two separate upper load-bearing support straps, again in contrast to the free, ribbonlike support straps known from the prior art, in the preferred embodiment not or optionally self-connecting and self-disconnecting with one another connected and enclose the sides of the body, once from the front and once from the rear. If the two free ends of the upper support straps enclose the body on the same side of the body (left or right), they may in an alternative embodiment also be releasably connected with one another as worn by means of closures.

The support straps are designed such that a fixed positioning of the support straps with respect to one another that ensures the necessary fit is enabled, where the support straps may, depending on the embodiment, each consist of multiple parts or stays and have any desired form, width, length, thickness, color, and degree of transparency. Both the support straps and their connecting points, the optional crotch piece, and the optional rear cover piece, as well as all other parts provided for the garment, consist of one material suitable for the purpose or multiple such materials in combination with one another, and which can assume any arbitrary form, insofar as the necessary purchase of the garment on the body and the concealment of the desired parts of the body provided for by the design are both assured.

BRIEF DESCRIPTION OF THE DRAWINGS

Further objectives, features, advantages, and possible applications of the garment in accordance with the invention, may be gleaned from the following description of an exemplary embodiment on the basis of the drawing.

The drawings depict the following.

DETAILED DESCRIPTION

Figure 1:
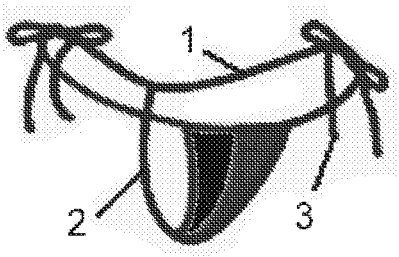
FIG. 1 Prior Art
FIG. 1 depicts a pair art T- or G-string with tied load-bearing straps as a closure for opening.

FIG. 5 through FIG. 28 depict the garment as worn. Due to its dimensional stability in the preferred embodiment, it is almost identical in this condition to its condition when not worn. As the support straps must supply the necessary tension to conform to the body, they are drawn together more strongly in the unworn state.

If the elasticity of the material in a further version is chosen accordingly, the garment can also be folded up e.g. for packing, provided that it still provides the necessary tractive force in its "unpacked", worn, and thus body-conforming state.

The garment itself comprises a single (4) upper or a front (9) and a rear (10) upper load-bearing support strap, and a lower support strap connected to them (5 respectively 11), where each upper support strap is connected at exactly one point (6 or 7 respectively 12 or 13) with the lower support strap (5 respectively 11) near the center of the body. The length, thickness, and width of all support straps (4,5 respectively 9,10,11) are variable in accordance with the shape of the areas of the body to be covered and with the design, provided that the function is achieved. Thus, the two ends of the upper support straps (4 respectively 9,10) as realized may also touch one another, overlap, etc., as long as they are not connected to one another.

Figure 6:
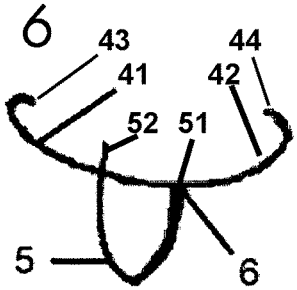
Figure 10:
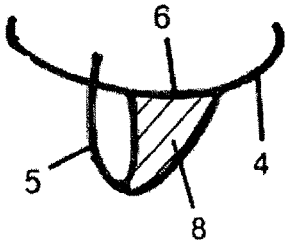
Figure 7:
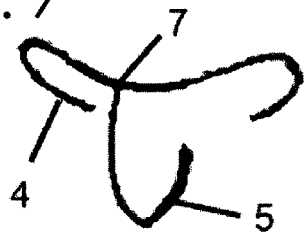
FIG. 7 and FIG. 8 each depict a thong as above, but with a front opening.
Figure 11:
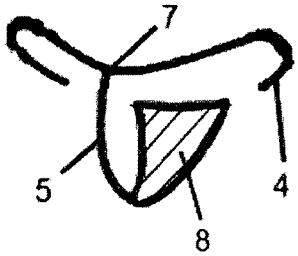
Figure 8:
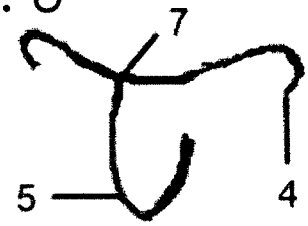
Figure 12:
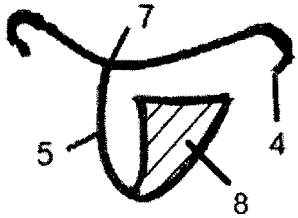
Figure 13:
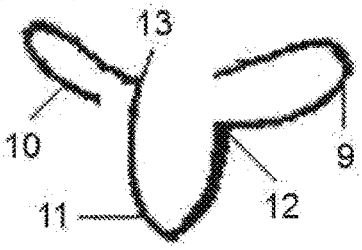
FIG. 13 and FIG. 14 depict a thong with an opening on the front left and right rear, with upper support straps of different length (view of front of body)
Figure 14:
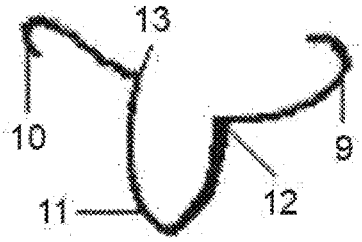
Figure 15:
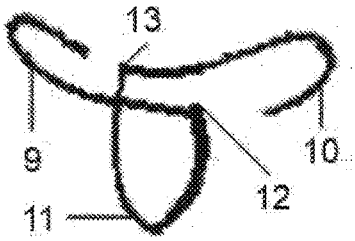
FIG. 15 and FIG. 16 depict a thong as above, but with an opening on the right front and left rear (view of front of body)
Figure 16:
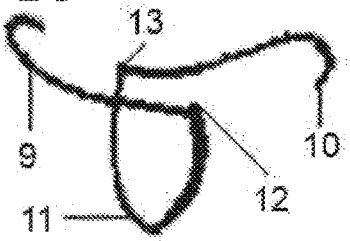
Figure 17:
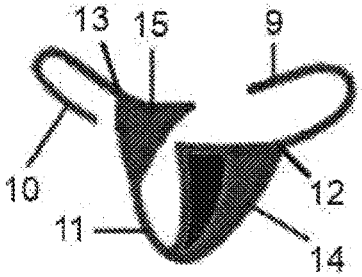
FIG. 17 through FIG. 20 depict the embodiments of FIG. 13 through FIG. 16 with a separate front crotch piece and with a separate rear covering.
Figure 18:
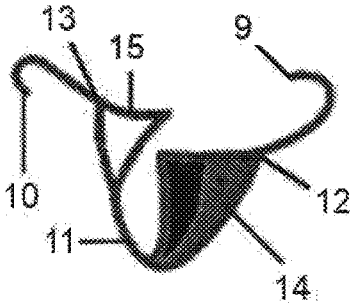
Figure 19:
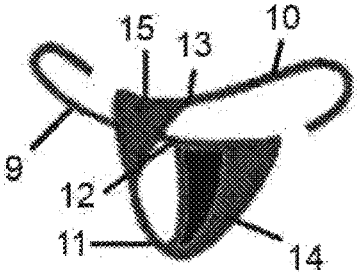
Figure 20:
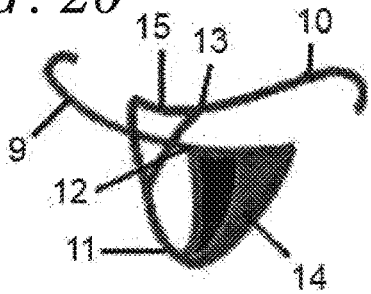
Figure 21:
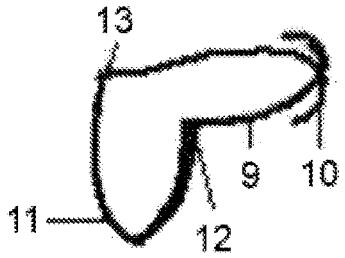
FIG. 21 depicts a thong with an open left side (view of front of body)
Figure 23:
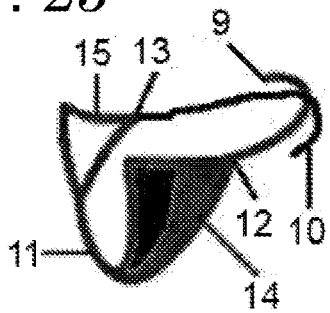
FIG. 23 and FIG. 24 depict the embodiments of FIG. 21 and FIG. 22 with a separate crotch piece and with a separate rear covering.
Figure 22:
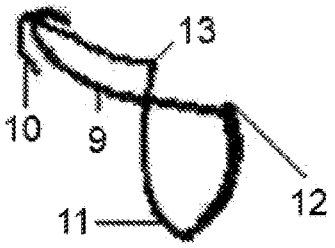
FIG. 22 depicts a thong with an open left side (view of front of body)
Figure 24:
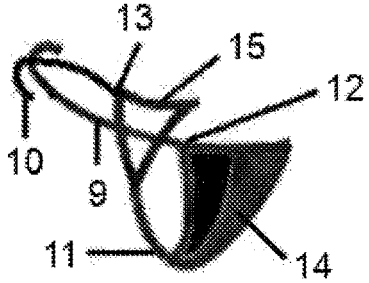
Figure 25:
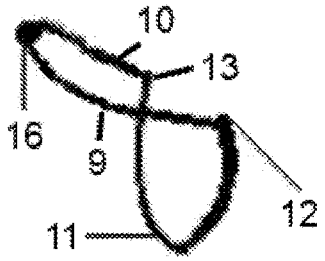
FIG. 25 depicts a thong with an open right side and front and rear support straps releasably connected on the left side of the body with a closure (view of front of body)
Figure 27:
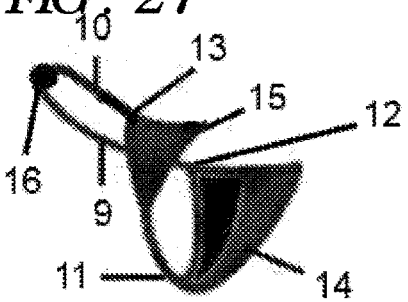
FIG. 27 and FIG. 28 depict the embodiments of FIGS. 25 and 26 with a separate crotch piece and with a separate rear covering.
Figure 26:
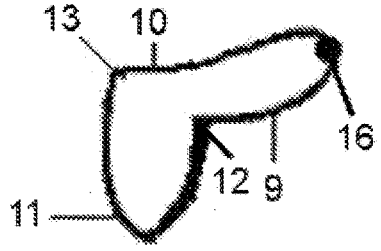
FIG. 26 depicts a thong with an open left side and front and rear support straps releasably connected on the right side of the body with a closure (view of front of body)
Figure 28:
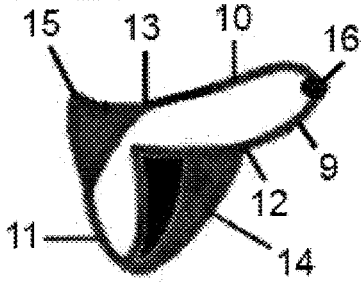

As shown in FIG. 6, the self-supporting garment may comprise a dimensionally stable and elastic first upper support strap 41 and a second upper support strap 42 arranged opposite the first upper support strap. The upper support straps 41,42 are connected to a lower support strap 5 at a first connection point 6. The lower support strap 5 is, like the upper support straps 41,42 dimensionally stable and elastic. The lower support strap 5 extends from a front end 51 to a single rear end 52. The first upper support strap 41, when in use, extends partially around a wearer's pelvis area, extending from the first connection point 6 more than 90 degrees and less than 180 degrees around the wearer's body. The second upper support strap 42, when in use, extends from the first connection point more than 90 degrees and less than 180 degrees around a wearer's pelvis area opposite the first support strap. Thus, an opening extends between a rear end 43 of the first upper support strap 41 and a rear end 44 of the second upper support strap 42.

An optional crotch piece 8 respectively 14 may be added either as a connector between support straps 4 and 5 (FIG. 9 and FIG. 10) respectively 9 and 11 (FIG. 17 through FIG. 20, FIG. 23, FIG. 24, FIG. 27 and FIG. 28), affixed or connected at the open end of the lower support strap 5 (FIG. 11 and FIG. 12), or optionally be attached on the front of the support strap 5 or 11 if the garment consists of only two (FIG. 5 through FIG. 8) respectively three (FIG. 13 through FIG. 16, FIG. 21, FIG. 22, FIG. 25 and FIG. 26) support straps. If a separate crotch piece 8 respectively 14 is lacking, a lower support strap 5 shaped in accordance with the necessary coverage requirements (FIG. 5 through FIG. 8) respectively 11 (FIG. 13 through FIG. 16, FIG. 21, FIG. 22, FIG. 25 and FIG. 26) itself provides coverage of the crotch. In the embodiment with three support straps, the lower support strap 11 can also be continuous through to the upper support strap 10, or a separate covering piece 15 for the buttocks/back may be inserted between them. The rear covering may also be attached only on the lower support strap 11.

If with three support straps the ends of the front upper support strap 9 and the rear upper support strap 10 meet on one side of the body, both can optionally be releasably connected with one another by means of a closure 16, where the closure 16 is preferably self-closing due to its design when the two ends of the support straps contact one another, and self-opening when pulled on (FIG. 25 through FIG. 28).

In a further embodiment, the optional closure 16 may also comprise one or more buttons, hooks, adhesive- and zipper closures.

Figure 2:
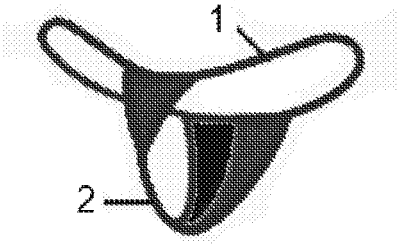
FIG. 2 Prior Art
FIG. 2 depicts a prior art String Tanga.
Figure 3:
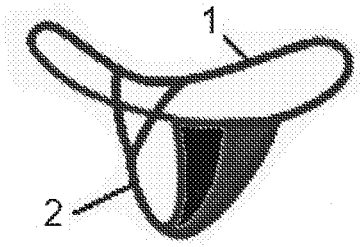
FIG. 3 Prior Art
FIG. 3 depicts a prior art Delta- or V-String.
Figure 4:
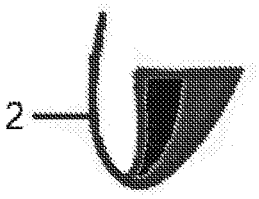
FIG. 4 Prior Art
FIG. 4 depicts a prior art C-string.
Figure 5:
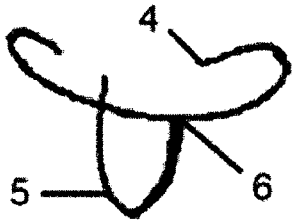
FIG. 5 and FIG. 6 depict a thong with a rear opening, with different length support straps; the lower support strap aids in covering the crotch.
Figure 9:
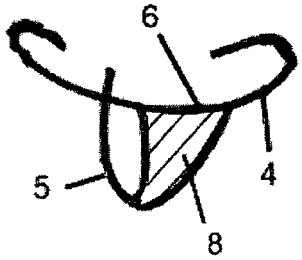
FIG. 9 through FIG. 12 depict the embodiments of FIG. 5 through FIG. 8 with a separate front crotch piece.

As can first be seen in FIG. 5 through FIG. 12, in the embodiment of the garment in accordance with the invention with an upper load-bearing support strap 4 has, either in the front or in the rear, no connection between the upper support strap 4 and the lower support strap 5 running between the legs (as is found in FIG. 1 through FIG. 3). As a connection between the two support straps 4,5 is absent on one side, the garment can be put on or pulled off from the opposing, open side by the elasticity of the support straps.

As can also be seen from FIG. 13 through FIG. 28, in the case of the garment in accordance with the invention having two upper load-bearing support straps 9,10, the front upper support strap 9 is connected in front by one end to the lower support strap 11, and the rear upper support strap 10 also connected by one end in the back with the lower support strap 11. The lower support strap 11 always runs between the legs. As a connection between the other ends of the two support straps 9,10 is absent on one side, the garment can be pulled up or down between the legs through the elasticity of the support straps. The ends of the two upper support straps 9,10 connected with the lower support strap 11 may also extend beyond the connecting points 12,13.

As a result of the direct front (6) or rear (7) connection between the support straps 4,5 that is still given in the case of a single upper support strap 4 opposite of the opening, or by means of the optional crotch piece 8 between them, the support straps are nonetheless held together, as the stability of the material of all components provides a good fit of the support straps 4,5 to the body. The upper support strap 4 is consequently held in position by the lower support strap 5, and the lower support strap 5 cannot fall off.

Similarly, in the case of two upper support straps 9 and 11, they are also held together by the front connection 12 between the support straps 9,11 and the rear connection 13 between the support straps 10,11, or by means of the optional crotch piece 14 between the support straps 9,11, or the optional rear covering 15 between the support straps 10,11, as here again, the stability of the material of all components ensures a good fit of the support straps 9,10,11 to the body. The upper support straps 9,10 are held in place against the body by the lower support strap 11, and the lower support strap 11 in turn cannot fall off downward due to the retention provided by the upper support straps 9,10.

The lower support strap 5 respectively 11 thus needs no or only minimal lateral tension between the legs to stay in place. The form and fit of the entire construction are determined by the rigidity and elasticity of the material chosen in accordance with the task for the two support straps 4,5 or the three support straps 9,10,11 and their connecting point(s) 7 or 6 or 12 and 13, as well as the optional components of the front crotch piece and rear covering piece.

The prevention of the downward slippage and falling off of the lower support strap 5 respectively 11 located between the legs is therefore ensured through adequate dimensional stability of the partially circumferentially upper support strap 4 respectively 9,10 and their connecting point(s) 7 (FIG. 5 through FIG. 12) respectively 12,13 (FIG. 13 through FIG. 28) with the lower support strap 5 respectively 11. Retention in position on the body is ensured by the stiffness and dimensional stability of the support straps 4,5 respectively 9,10,11 which nonetheless possess sufficient elasticity as a result of their constituent material to avoid slippage or falling off. The adequate dimensional stability of the lower support strap 5 also ensures that the latter does not dangle like a thread suspended at one end, but always conforms to the body between the legs. The only condition for the good fit of the garment as a whole against falling down is that both ends of the upper support strap 4 extend beyond the middle of the body on both sides, or that the outer ends of each of the upper support straps 9,10 also extend beyond the middle of the body on each side, and thus partially enclose the body minimally a little further than to the middle of the body's side as shown in FIG. 6, FIG. 8 FIG. 10 and FIG. 12 respectively FIG. 14, FIG. 16, FIG. 18, FIG. 20 through FIG. 24, or, in the case of two upper support straps, are connected with one another in their non-preferred embodiment (FIG. 25 through FIG. 28). The more pronounced the pelvis depending on the position of the support straps 4 respectively 9,10 (in the preferred embodiment, FIG. 5 through FIG. 24), the further the ends of the two support straps must generally extend at least beyond the middle of the body on the sides (FIG. 5, FIG. 7, FIG. 9 and FIG. 11 respectively FIG. 13, FIG. 15, FIG. 17, FIG. 19). A condition for conforming to the body is, in the case of an upper support strap 4, that the lower support strap 5 also extends beyond the middle of the body, and, in the case of two upper support straps 9,10, that the lower support strap 11 connects the two upper support straps 9,10 between the legs.

The width, length, thickness, and form (such as, e.g., an optional multi-part or multi-stay construction) of the support straps 4,5 in FIG. 5 through FIG. 12 respectively 9,10,11 in FIG. 13 through FIG. 28 may be selected arbitrarily, provided that functionality is assured. The upper support straps 4 respectively 9,10 need not enclose the body horizontal; they may provide a good fit in any other position. The lower support straps 5 respectively 11 need not connect vertically and at right angles to the upper support straps 4 respectively 9,10, but may attach to/be connected at any points on the closed side of the upper support strap 4 or in front with the front upper support strap 9 and in the rear with the rear upper support strap 10 and accordingly run downward at an angle, so that they can pass through between the legs and cover the required areas of the body.

In a further embodiment, the support straps 4,5 respectively 9,10,11 and the optional crotch pieces 8 respectively 14 and/or the optional rear covering 15 may also be releasably connected to one another at the connecting points 7 or 6 respectively 12 and/or 13 by closures, adhesive-, plug-, or other connectors, e.g. in order that the garment may be disassembled into its component parts when not worn so as to occupy less space, provided that the necessary dimensional stability and elasticity of the garment are retained. This can additionally or supplementarily be achieved through corresponding joints, and/or through components that are collapsible or foldable.

In a further embodiment, the support straps 4 and 5 and the optional crotch piece 8 may also be formed as a single piece.

Likewise in a further embodiment, the support straps 9,10,11, the optional crotch piece 14, and the optional rear covering 15 may all or in part be formed as a single piece.

Depending on their material, design, and shape, the support straps 4,5 respectively 9,10,11 follow possible expansions of the body (e.g. during breathing, pulling in the stomach, etc.). Proper design ensures that the areas of the body to be concealed remain covered during permitted movements of the wearer.

Possible materials include, e.g., preferably plastic or metal, but also tissues or fabrics with or without a (partial) (fabric) covering. The materials may be decorated with prints, ornaments, or other designs, provided that they have the necessary dimensional stability.

The invention provides that with an upper support strap 4 (FIG. 5 through FIG. 12), the lack of a connection between the support straps 4,5 and the non-continuous upper support strap 4 resulting from the one-sided opening in the front or back allows the garment can be put on and taken off by putting it on and pulling it off from the opposite side without needing to open closures, and without the need for drawing it over the legs.

With two upper support straps 9 and 10, the opening on both sides, front and back, allows the garment to be put on from beneath and pulled down from beneath in the preferred embodiment (FIG. 13 through FIG. 24) with needing to open closures, and its one front and one rear support strap mechanically prevent the garment from being pulled off from the front or back. In the further version (FIG. 25 through FIG. 28), the garment can be pulled off downward after opening of the closure 16 or put on and the closure 16 closed.

Furthermore, the present garment with a single upper support strap 4 for the first time allows, depending on the position of the opening, bare buttocks/back or an uncovered abdomen, without simultaneously having completely bare, "naked" sides (FIG. 5 through FIG. 12). In addition, with two upper support straps 9 and 10, the garment for the first times makes it possible to have simultaneously partially uncovered buttocks/back and a partially uncovered back, without having completely uncovered, "naked" sides, in the versions having one right and one left support strap (FIG. 13 through FIG. 20), respectively only a single uncovered side of the body in the embodiments in FIG. 21 through FIG. 28. For both embodiments, reasons could be of an aesthetic or fashionable nature, or practical (avoidance of tan lines on the buttocks or abdomen).

While constantly ensuring that the area between the legs remains covered, the garment in accordance with the invention permits new forms and designs which were not previously possible. If a single upper support strap 4 is used, panties that do not cover the buttocks or abdomen are possible, while the sides of the body remain wholly or partially covered. If two upper support straps 9,10 are used, panties that partially do not cover the buttocks/back or abdomen are possible, while one side of the body remains covered, in whole or in part, and protection against the uncovering of the area between the legs is assured.

If uncovered buttocks/back are not desired, the upper support strap 4 may be fully encircling, provided that the ends only touch or overlap one another and are not connected by means of a closure. Similarly, the upper support strap 4 can also touch the lower support strap in a non-connection area without being connected to it—e.g. by means of a connector—so that the putting on or taking off of the garment is assured without the need to open closures or draw the garment over the legs. In the same way, the upper support straps 9,10 of the preferred version in accordance with FIG. 13 to FIG. 20 can be fully encircling, provided that their ends only touch or overlap one another and are not connected by means of a closure, so that the putting on or taking off of the garment is assured without the need to open closures or draw the garment over the legs. The further versions of FIG. 25 through FIG. 28 also permit the garment to be put on and taken off without the involvement of the legs, as one side is open and the closure 16 of the other side is to be opened.

If the two ends of the upper support strap 4 touch one another or overlap, or if the upper support strap 4 and lower support strap 5 touch in the unconnected area, this does not negatively affect functionality provided that they are not connected, i.e. as long as they do not hinder the putting on and taking off of the garment. The same applies for the unconnected ends of the upper support straps 9,10.

For situations placing higher demands on a secure fit of the garment on the body, e.g. during athletic activities such as ball games, the support straps 4,5 or 9,10,11 and/or the optional crotch piece 8 respectively 14 and/or the optional rear covering 15 may supplementally be directly coated on their inner surfaces, in whole or in part, with a material that sticks to or increases friction on the skin, and/or permanently or releasably have elements attached to them facing the skin that stick to or increase friction on the skin.

The garment in accordance with the invention is not limited in its embodiments to the preferred embodiments listed above.

LIST OF REFERENCE SIGNS

4 upper support strap
5 lower support strap
6 front connecting point of upper support strap 4 and lower support strap 5
7 rear connecting point of upper support strap 4 and lower support strap 5
8 optional crotch piece in the case of a single upper support strap
9 front upper support strap
10 rear upper support strap
11 lower support strap between the front (9) and rear (10) upper support strap
12 front connecting point of front support strap 9 and either a lower connector 11 or optional crotch piece 14
13 rear connecting point of rear support strap 10 and either a lower connector 11 or optional rear covering piece 15
14 optional crotch piece in the case of two upper support straps
15 optional rear covering piece in the case of two upper support straps
16 optional closure in the case of two upper support straps

The invention claimed is:

1. A self-supporting garment, comprising:
a dimensionally stable and elastic first upper support strap;
a dimensionally stable and elastic lower support strap extending from a front end to a single rear end; and
a first connection point connecting the lower support strap to the upper support strap,
wherein the first upper support strap, when in use, extends partially around a wearer's pelvis area, extending from the first connection point more than 90 degrees and less than 180 degrees around the wearer's body, and
wherein the lower support strap, when in use, extends between the wearer's legs and cover's the wearer's crotch.

2. The self-supporting garment as in claim 1, further comprising
a second upper support strap arranged opposite the first upper support strap,
wherein the second upper support strap, when in use, extends from the first connection point more than 90 degrees and less than 180 degrees around a wearer's pelvis area.

3. The self-supporting garment as in claim 2, wherein the first connection point, when in use, is arranged on the wearer's front and wherein an opening extends between a rear end of the first upper support strap and a rear end of the second upper support strap.

4. The self-supporting garment as in claim 2, wherein the first connection point, when in use, is arranged on the wearer's back and wherein an opening extends between a front end of the first upper support strap and a front end of the second upper support strap.

5. The self-supporting garment as in claim 2, wherein the first upper support strap, the second upper support strap, and the lower support strap are releasably connected at the first connection point.

6. The self-supporting garment as in claim 2, wherein at least two members of the group consisting of the first upper support strap, the second upper support strap, and the lower support strap are formed as an integral component.

7. The self-supporting garment as in claim 2, further comprising a crotch piece arranged at the front end of the lower support strap.

8. The self-supporting garment as in claim 2, wherein the width of the lower support strap is selected such that the lower support strap, when in use, covers the crotch area of the wearer.

9. A self-supporting garment, comprising:
a dimensionally stable and elastic first upper support strap;
a dimensionally stable and elastic lower support strap; and
a rear connection point connecting a rear end of the lower support strap to a rear end of the first upper support strap,
wherein the first upper support strap, when in use, extends more than 90 degrees and less than 180 degrees around a wearer's pelvis area from the rear connection point at the wearer's back, and
wherein the lower support strap, when in use, extends between the wearer's legs.

10. The self-supporting garment as in claim 9, further comprising
a second upper support strap arranged opposite the first upper support strap,
wherein the second upper support strap, when in use, extends from the rear connection point more than 90 degrees and less than 180 degrees around a wearer's pelvis area.

11. A self-supporting garment, comprising:
a dimensionally stable and elastic first upper support strap;
a dimensionally stable and elastic second upper support strap;
a dimensionally stable and elastic lower support strap;
a rear connection point connecting a rear end of the lower support strap to a rear end of the first upper support strap; and
a front connection point connecting a front end of the lower support strap to a front end of the second upper support strap,
wherein the first upper support strap, when in use, extends more than 90 degrees and less than 180 degrees around a wearer's pelvis area from the rear connection point at the wearer's back, and
wherein the second upper support strap, when in use, extends more than 90 degrees and less than 180 degrees around a wearer's pelvis area from the front connection point at the wearer's front, and
wherein the lower support strap, when in use, extends between the wearer's legs.

12. The self-supporting garment as in claim 11 wherein two or more members selected from the group consisting of the first upper support strap, the second upper support strap, the lower support strap, the rear connection point, and the front connection point are formed as an integral component.

13. The self-supporting garment as in claim 11,
wherein a front end of the first upper support strap is not connected to any other element and wherein a rear end of the second upper support strap is not connected to any other element.

14. The self-supporting garment as in claim 11, further comprising a crotch piece arranged at the front end of the lower support strap.

15. The self-supporting garment as in claim 11, wherein the width of the lower support strap is selected such that the lower support strap covers the crotch area of the wearer.

16. The self-supporting garment as in claim 11, further comprising a rear covering piece arranged at the rear end of the lower support strap.

17. The self-supporting garment as in claim 11, wherein the first upper support strap and the second upper support strap are arranged on opposite sides of the wearer's pelvis area.

18. The self-supporting garment as in claim 11, wherein the first upper support strap and the second upper support strap are arranged on the same side of the wearer's pelvis area.

19. The self-supporting garment as in claim 18, wherein a front end of the first upper support strap and a rear end of the second upper support strap are releasably connected by a closure.

* * * * *